United States Patent [19]

Teeny et al.

[11] Patent Number: 4,848,583

[45] Date of Patent: Jul. 18, 1989

[54] TRAY HAVING WEB SECURED IN FRAME

[75] Inventors: Samuel J. Teeny; Parry S. Teeny; Rickey R. Teeny, all of Portland, Oreg.

[73] Assignee: Middle East Bakeries, Incorporated, Portland, Oreg.

[21] Appl. No.: 159,341

[22] Filed: Feb. 22, 1988

[51] Int. Cl.[4] ..... B65D 1/34

[52] U.S. Cl. ..... 206/557; 220/70; 220/76

[58] Field of Search ..... 206/557; 220/70, 76; 249/114.1, DIG. 1, 127, 134

[56] References Cited

U.S. PATENT DOCUMENTS

| | | | |
|---|---|---|---|
| 1,220,457 | 3/1917 | Reese . | |
| 2,212,743 | 8/1940 | Kremmling . | |
| 2,226,323 | 12/1940 | Pointon . | |
| 3,037,608 | 6/1962 | Rothschild . | |
| 3,243,075 | 3/1966 | Reinke | 220/76 |
| 3,559,836 | 2/1971 | Pink et al. | 206/557 |
| 4,139,115 | 2/1979 | Robinson | 220/74 |
| 4,616,746 | 10/1986 | Thomas | 206/557 |

FOREIGN PATENT DOCUMENTS

| | | | |
|---|---|---|---|
| 1224705 | 9/1966 | Fed. Rep. of Germany . | |
| 2163725 | 6/1973 | Fed. Rep. of Germany | 206/557 |

*Primary Examiner*—Joseph Man-Fu Moy

*Attorney, Agent, or Firm*—Kolisch, Hartwell & Dickinson

[57] ABSTRACT

The tray of the instant invention includes a frame, having a rigid core with a plastomer coating thereover. An air-permeable web is disposed over the frame in a taut condition such that the web smoothly meets the frame and that the top side of the frame and the web form a continuous, planar surface.

The method of baking a bakery product according to the invention includes the steps of preparing the dough for the product and forming the dough into a desired shape for individual product pieces. The individually formed pieces are placed on a tray having an air-permeable mesh disposed on the upper, planar surface of the tray and the pieces are proofed on the trays for a predetermined time period. The trays are removed, with the pieces carried thereon from the proofing stand and transported on a support conveyor. The pieces are mechanically picked off of the trays with a pickup conveyor and then moved through a baking oven on the pickup conveyor.

5 Claims, 2 Drawing Sheets

TRAY HAVING WEB SECURED IN FRAME

BACKGROUND AND SUMMARY OF THE INVENTION

The instant invention relates to a tray, and specifically to a bakery tray and the application of the tray when used as a support tray in a baking line.

One application for the invention is in the baking of bread products such as pita bread. Pita bread is formed from dough which includes yeast, flour and water and which, after being mixed, is formed into oval patties approximately 6 inches in length and 4 inches in width. The patties must sit for a period of time, which is referred to as proofing, during which time the ingredients act to form a product, which when baked, will have a hollow center.

Proofing normally occurs with the products on wooden trays, which are generally covered with a piece of cloth to absorb moisture which is given off from the bottom of the product piece which is supported on the tray. Trays so formed are difficult to clean and maintain, and the cloth used thereon must be laundered in between uses to prevent contamination and spoilage of product.

Once proofed, the product pieces must be removed from the proofing tray and baked. The product may be baked on conventional oven racks, or may be baked on a conveyor which moves through an oven. In either case, conventional techniques require manual handling of the product pieces between the proofing tray and the oven.

An object of the instant invention is to provide a method of baking a product which includes minimal manual handling thereof.

Another object of the instant invention is to provide a novel tray which has a planar, air-permeable upper surface. A corollary is to provide such a tray having an outer frame comprising a core with a plastomer coating and a screen joined to the frame through the polymer coating.

Still another object of the invention is to provide a bakery tray which is easy to clean and maintain.

A further object of the present invention is to provide a bakery tray which will not absorb moisture from the product being proofed thereon.

These and other objects and advantages of the invention will become more apparent as the description which follows is read in conjunction with the drawings.

DETAILED DESCRIPTION OF THE PREFERRED EMBODIMENTS

Figure 1:
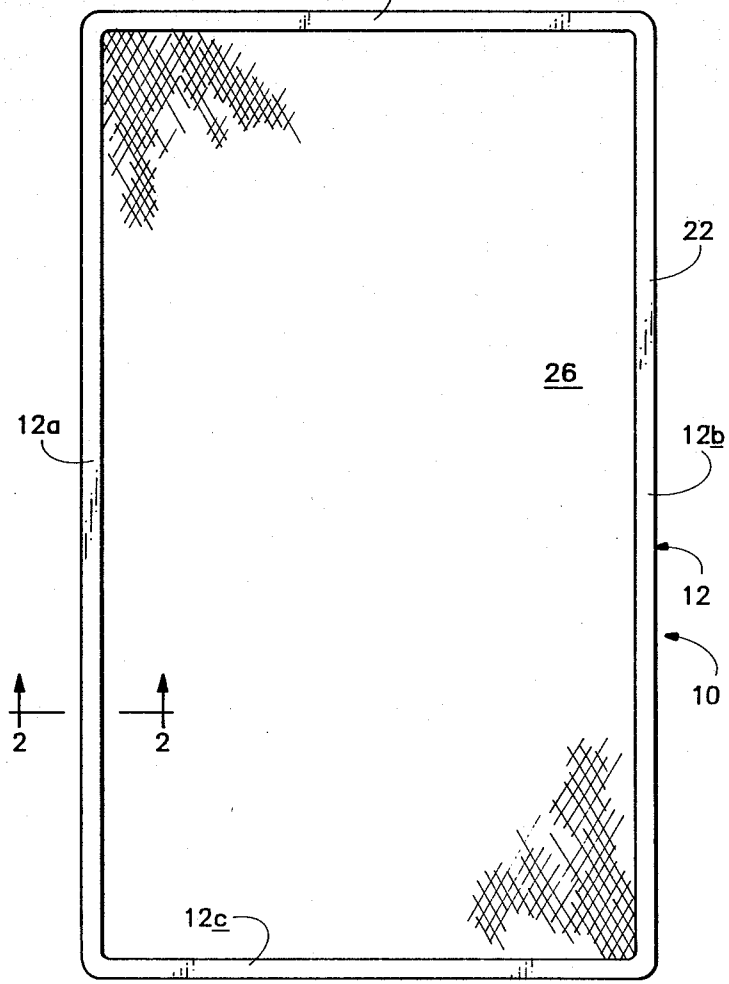
FIG. 1 is a top plan view of the baking tray of the invention.
Figure 2:
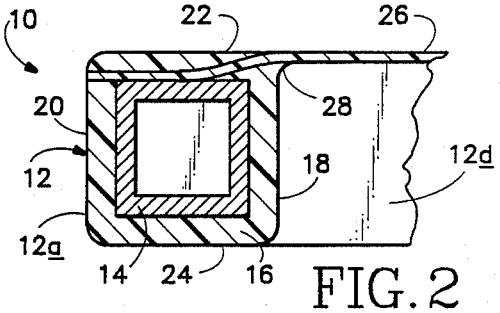
FIG. 2 is a cross section through an edge of the baking tray, taken generally along the line 2—2 of FIG. 1.

Turning now to the drawings and initially to FIGS. 1 and 2, a bakery tray constructed according to the invention is shown generally at 10. In the preferred embodiment, tray 10 includes a generally rectangular outer frame 12 forming the perimeters of the tray which includes a rigid core 14 and a coating 16. In the preferred embodiment core 14 has a substantially rectangular or square cross section, and is constructed from square metal tubing. A core having a round cross section may also be used. A solid core may be used, but the tubing provides a higher strength-to-weight ratio.

Frame 12 includes an inner margin 18, an outer margin 20, a top side 22 and a bottom 24. Frame 12 has opposed long sides **12*a*, 12*b* and spaced apart opposed short sides, or ends, 12*c*, 12*d***.

A web 26 is disposed over frame 12 in a taut condition. Web 26 is secured to frame 12 by coating 16, which in the preferred embodiment is a plastomer coating surrounding core 14 and having a substantially uniform thickness. As depicted in FIG. 2, web 26 extends across the upper portion of core 14 through top side 22 of the frame and exits the coating, smoothly, at the juncture of top side 22 and inner margin 18. This arrangement provides for a continuous, planar surface between top side 22 and web 26.

A web supporting lip 28 is integrally formed in coating 16 on the underside of web 26 and inner margin 18. Lip 28 provides additional support for web 26 and maintain a smooth, contiguous planar surface between web 26 and the top side of the frame.

Web 26, in the preferred embodiment, is formed of an air-permeable, polymer mesh screen which is constructed and arranged to allow air circulation therethrough. The material used in the preferred embodiment is a monofilament nylon woven mesh.

Figure 4:
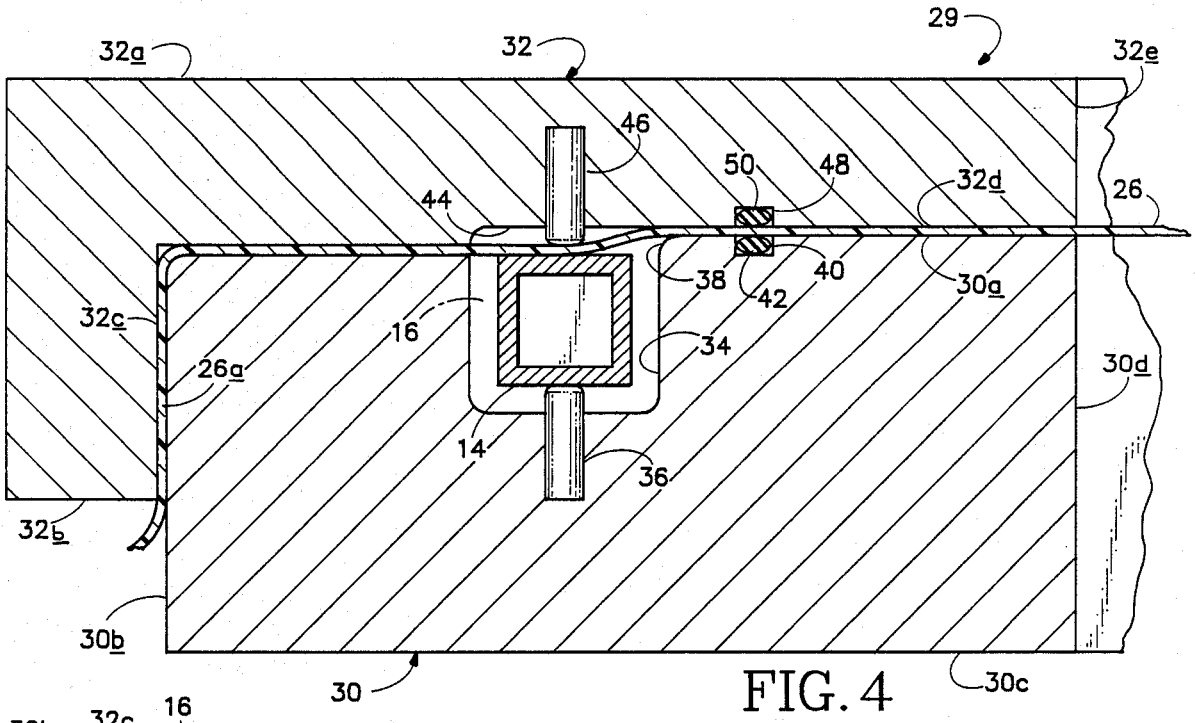
FIG. 4 is a sectional view of the mold of FIG. 3, taken generally along the line 4—4 of FIG. 3.
Figure 3:
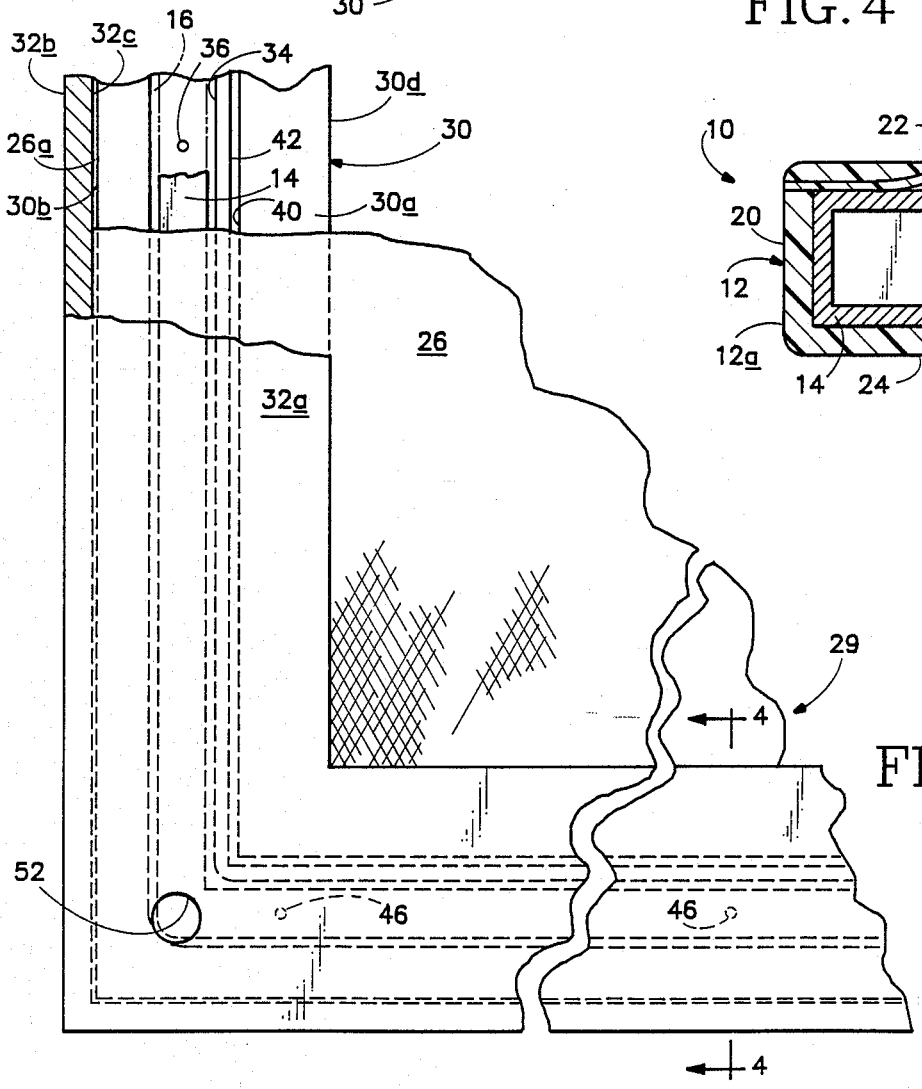
FIG. 3 is a top plan view of a mold used to fabricate the baking tray of the invention, with portions broken away to show detail.

Tray 10 is formed by a reaction injection molding process. Referring now to FIGS. 3 and 4, a mold which is used to form tray 10 is depicted at 29.

Bottom mold half 30 has a top side **30*a*, an outer edge 30*b*, a bottom surface 30*c*, and an inner edge 30*d*. Top mold half 32 has a top surface 32*a*, a lip 32*b*, a lip inner surface 32*c*, a bottom side 32*d* and an inner edge 32*e***.

Bottom mold 30 includes a cutout portion 34 which has support pins 36 positioned along the course thereof. Cutout 34 includes a lip-forming structure 38 which is operable, when the mold is injected with resin, to form web supporting lip 28.

A groove 40 extends about mold half 30 and has an O-ring 42 received therein.

Top mold half 32 has a cutout 44 formed therein which has pins 46 distributed therealong. A groove 48 receives an O-ring 50 which is positioned to co-act with O-ring 42. To. prepare mold 29, core 14 is inserted into cutout 34. The core rests on pins 36, which provide spacing between the bottom of the cutout and the core, to allow the coating material to flow about the core. A web 26 is positioned over bottom mold half 30 ad core 14. Top mold half 32 is positioned over the bottom mold half, with mold outer edge **30*b* and inner lip surface 32*c* initially providing tension on the free edge 26*a* of web 26, thereby bringing the web into a taut condition over core 14. Pins 46 provide additional tension and hold web 26** in a desired position prior to the injecting process.

Once the mold halves are assembled with the web and core in place, the assembled mold is moved to an injection area, where an appropriate resin is injected through port 52, thereby forming coating 16 about core 14.

With the tray formed in the manner described, any wrinkles which may be present in the web material will be enclosed in the coated portion of the frame. O-rings 42 and 50 are operable to prevent extravasation of the resin material into the central portion of the screen.

Once the resin has set, the mold and pins are removed to leave the completed bakery tray.

Figure 6:
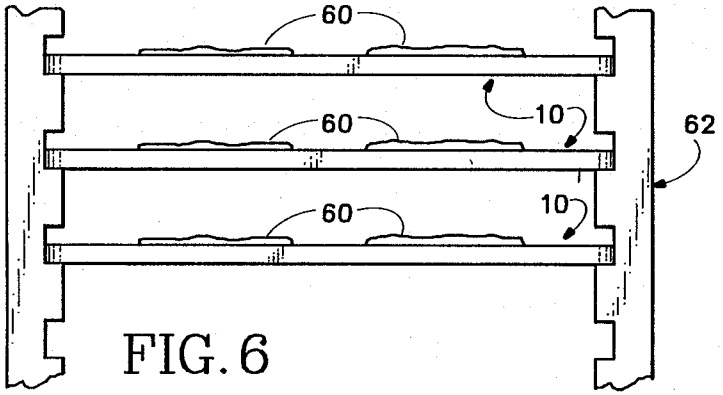
FIG. 6 is a front plan view of the baking trays of the invention, with product pieces thereon, stored in a proofing stand, which is shown in fragmentary view.
Figure 5:
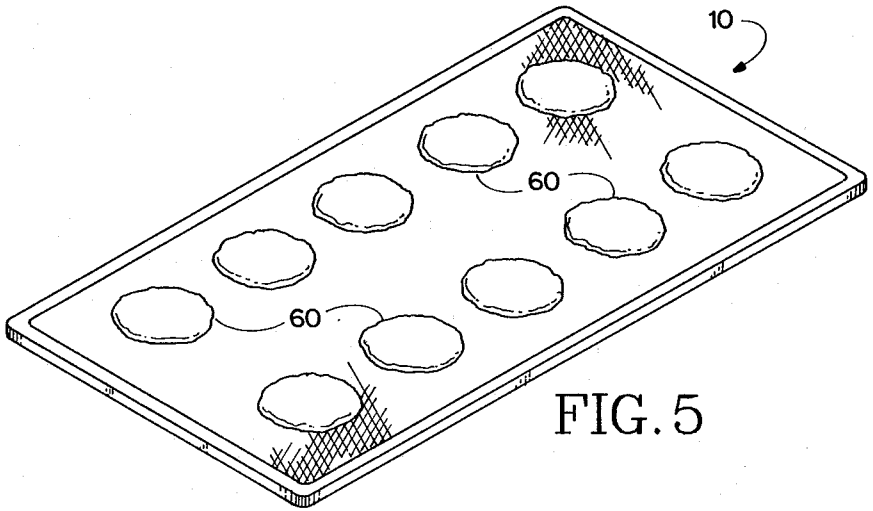
FIG. 5 is a perspective view of the baking tray of FIG. 1, with product pieces distributed thereon.

Referring now to FIGS. 5 and 6, the method of baking a bakery product according to the invention will be described. Initially, the dough is prepared for the product and is formed into a desired shape, which is generally an oval form, for the individual product pieces. In FIG. 5, product pieces 60 are depicted on a bakery tray 10 constructed according to the invention. The individually formed pieces are placed on tray 10, which has an air-permeable mesh disposed on the upper, planar surface thereof.

Referring now to FIG. 6, the pieces are proofed on the trays for a predetermined time period with the trays received in a proofing stand 62 having appropriate elements therein for receiving a plurality of trays 10 having product pieces 60 thereon. In the proofing stand, air is allowed to circulate around the product pieces, drawing moisture therefrom, while the product pieces are proofed, or allowed to rise.

Figure 7:
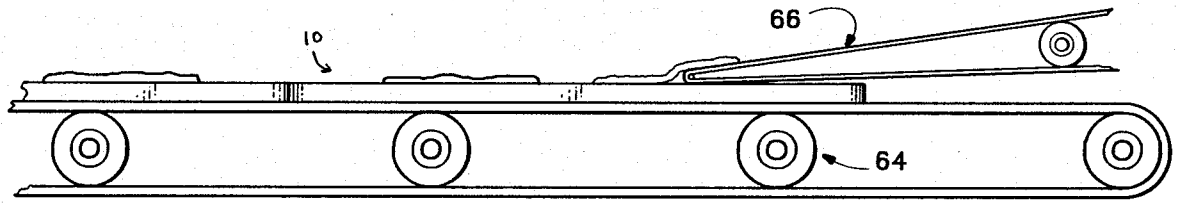
FIG. 7 is a somewhat schematic side view of a support and pickup conveyor as used in the method of the invention.

Once the product pieces have been proofed, trays 10 are removed from proofing stand 62, with the product pieces thereon, and are transported on a support conveyor, shown generally at 64 in FIG. 7. A pickup conveyor 66 is operable, when the trays pass thereadjacent to pickup the product pieces from the upper surfaces of the bakery trays and move the pieces through a baking oven (not shown) with the pieces carried on the pickup conveyor.

Thus, once the product pieces have been formed and deposited on the bakery tray, they do not require further individual handling until they are fully baked. The construction of the bakery trays of the invention is such that pieces of dough and flour particles are easily rinsed from the web, ensuring that the trays remain sanitary and are quickly reusable for successive batches of product.

The trays of the invention are easily formed through an injection molding process and are light weight and durable.

The invention is not restricted to the particular embodiments which have been described, since variations may be made therein without departing from the scope of the invention as defined in the appendant claims.

It is claimed and desired to secure as letters patent:

1. A bakery tray comprising:

a rectangular frame bordering an inner space and having an outer margin, an inner margin and a top side extending between said margins; and an air-permeable mesh screen spanning said inner space, wherein said screen has margins embedded in said frame and which smoothly meets said frame at the juncture of said top side and said inner margin such that said top side and said web form a continuous, planar surface.

2. The tray of claim 1 wherein said frame includes a rigid core and a plastomer coating thereover, and wherein said screen is embedded in said coating and is secured to said frame by said plastomer coating.

3. The tray of claim 2 wherein said frame has a screen-supporting lip integrally formed about the inner margin thereof in said plastomer coating and located on the underside of said screen.

4. The tray of claim 2 wherein said core has a substantially rectangular cross section.

5. The tray of claim 4 wherein said plastomer coating has a uniform thickness about said core.

* * * * *